United States Patent [19]

Cundari

[11] Patent Number: 4,858,629

[45] Date of Patent: Aug. 22, 1989

[54] INCREASED VOLUME SYNTHETIC FIBRES, PROCEDURE FOR PRODUCING THEM AND THEIR USE, IN PARTICULAR FOR FILTERS

[75] Inventor: Francesco Cundari, Brindisi, Italy

[73] Assignee: S.P.T. S.r.l., Lecce, Italy

[21] Appl. No.: 889,321

[22] Filed: Jul. 23, 1986

[30] Foreign Application Priority Data

May 9, 1986 [IT] Italy ..... 20386 A/86

[51] Int. Cl.[4] ..... D01D 5/247; D01D 5/253; D01F 6/06; B29C 67/22

[52] U.S. Cl. ..... 131/332; 131/331; 131/342; 264/45.3; 264/54; 264/136; 264/168; 264/235.6; 264/288.8; 264/346; 264/DIG. 16; 428/394; 428/397; 428/398

[58] Field of Search ..... 264/54, 45.3, DIG. 16, 264/DIG. 8, 51, 53, 288.8, 136, 168, 235.6, 346; 131/331, 332, 342; 428/398, 394, 397

[56] References Cited

U.S. PATENT DOCUMENTS

| | | | |
|---|---|---|---|
| 3,118,161 | 1/1964 | Cramton | 264/DIG. 16 |
| 3,127,915 | 4/1964 | Bottomley | 264/DIG. 8 |
| 3,214,234 | 10/1965 | Bottomley | 264/DIG. 16 |
| 3,303,045 | 2/1967 | Newman | 264/DIG. 16 |
| 3,315,455 | 4/1967 | Stoller | 264/DIG. 16 |
| 3,353,346 | 11/1967 | Laureti | 264/DIG. 16 |
| 3,411,979 | 11/1968 | Lewis, Jr. | 264/54 X |
| 3,422,171 | 1/1969 | Oppenlander | 264/54 X |
| 3,542,909 | 11/1970 | Breukink et al. | 264/DIG. 8 |
| 3,549,467 | 12/1970 | Keuchel et al. | 264/DIG. 8 |
| 3,549,470 | 12/1970 | Greenwald et al. | 264/DIG. 8 |
| 3,576,931 | 4/1971 | Chopra et al. | 264/DIG. 8 |
| 3,594,459 | 7/1971 | Keuchel | 264/DIG. 8 |
| 3,608,009 | 9/1971 | Changani | 264/DIG. 8 |
| 3,611,699 | 10/1971 | Wininger, Jr. et al. | 264/DIG. 8 |
| 3,634,564 | 1/1972 | Okamoto et al. | 264/54 |
| 3,640,921 | 2/1972 | Eberle et al. | 264/DIG. 16 |
| 3,641,760 | 2/1972 | Keuchel | 264/51 X |
| 3,645,085 | 2/1972 | Rassart | 264/DIG. 8 |
| 3,672,013 | 6/1972 | Vernon et al. | 264/DIG. 8 |
| 3,962,388 | 6/1976 | Driscoll | 264/54 X |
| 3,969,472 | 7/1976 | Driscoll | 264/54 X |
| 4,054,550 | 10/1977 | Parker et al. | 264/DIG. 16 |
| 4,562,022 | 12/1985 | Li et al. | 264/54 |

FOREIGN PATENT DOCUMENTS

| | | | |
|---|---|---|---|
| 932612 | 8/1973 | Canada | 264/DIG. 16 |
| 40-1817 | 2/1965 | Japan | 264/DIG. 8 |
| 47-23968 | 7/1965 | Japan | 264/DIG. 16 |

OTHER PUBLICATIONS

*Whittington's Dictionary of Plastics,* First Edition by Lloyd R. Whittington, Stamford, Conn., Technomic, c1968, Preface; pp. 179, 180, 181.

*The American Heritage Dictionary,* Second College Edition, Boston, Houghton Mifflin, c1982, pp. 535, 1025.

*Primary Examiner*—Philip Anderson

*Attorney, Agent, or Firm*—Herbert Dubno

[57] ABSTRACT

An increased volume synthetic fiber consists of a porous central core and a large number of short porous lateral threads integral with the core and distributed along the whole length of the fiber so as to form a voluminous branching structure. The process used to produce the fiber consists of the mixing of a synthetic polymer with an expanding agent which expands when heated, then spinning by melting the mixture which results in the expansion and fringing of the threads produced, caused by the expansion agent, followed by the drawing and fixing of the threads thus produced while they are still hot.

24 Claims, 1 Drawing Sheet

INCREASED VOLUME SYNTHETIC FIBRES, PROCEDURE FOR PRODUCING THEM AND THEIR USE, IN PARTICULAR FOR FILTERS

FIELD OF THE INVENTION

The invention relates to increased volume synthetic fibers the process used to produce them, and the use of the fibers, with special reference to the production of filters. It is known that synthetic fibers produced by means of spinning have a 'compact' structure.

BACKGROUND OF THE INVENTION

For certain uses requiring fibrous masses with a certain degree of porosity, for example in the manufacture of filters, the porosity required is in reality that which can be obtained with non-woven fabrics or rovings, even carded rovings, i.e. a porosity that is, so to speak, 'inter-filamentary', created by the interstices formed between the individual fibres that make up the non-woven fabric.

Now a new type of porous structure fiber has been found which is able to replace the porous fibrous masses so far used in all kinds of applications, with considerable advantages in terms of the consumption of materials and of cost.

OBJECT OF THE INVENTION

The main object of this invention is to provide a new type of porous synthetic fiber enabling savings to be made in terms of materials and costs in applications which require the use of porous fibrous masses.

Another object of the invention is to provide a process for the production of the abovementioned porous fibers able to be performed using the same type of machinery traditionally used to produce conventional 'compact' fibers.

Yet another object of the invention is to provide an improved specific practical application of the fibers that are the subject of the invention, or more specifically, a filter for cigarettes utilizing the fibers.

More specifically, the invention has the object of providing a filter for cigarettes which is highly selective with regard to the tar contained in cigarette smoke and also possesses a high condensation capacity with regard to the various distillates of the smoke itself.

Still another important object of the invention is that of providing a cigarette filter which satisfies the requirements of the user in terms of rigidity and which at the same time is able to increase the absorption of the products of combustion of cigarette tobacco.

A further object of the invention is to create a cigarette filter which does not alter the taste of the cigarette, in terms of the tobacco, and which is at the same time easy to breathe through and able to filter effectively the harmful substances generated by the combustion of the cigarette.

Still another object of the invention is to obtain a high degree of condensate absorption for each cigarette, together with an improved capacity of the filter to hold a high degree of moisture, nicotine and tar.

It is also an object of the invention to provide a cigarette filter, and a procedure for manufacturing it, which as well as considerably reducing the costs of producing the filter also makes it possible to considerably increase the quality of the absorption of the harmful substances produced during the inhalation of the smoke.

SUMMARY OF THE INVENTION

All these and other objects, which will become clearer from the description which follows, are achieved with a synthetic fiber consisting of a porous central core and a large number of porous lateral filaments integral with the core but shorter than it. These filaments are distributed along the entire length of the fiber so as to form a ramified fiber structure with increased voluminosity.

According to another aspect of the invention, the process for producing increased volume synthetic fibers each consisting of a porous central core and a number of porous lateral filaments integral with the core and shorter than it, with the filaments being distributed along the whole length of the fiber so as to form a ramified structure, comprises the steps of:

(a) cold mixing a fiber forming synthetic polymer with an inflating or expanding (blowing) agent;
(b) spinning by melting the mixture formed in step (a) in order to obtain the said ramified structure through the inflation and fringing of the fibers caused by the inflating agent;
(c) drawing of ramified structure fibers obtained in step (b); and
(d) fixing the drawn fibers by heating them in a furnace.

Finally, according to a further aspect of the invention the objects of the invention are achieved by a process for the manufacture of a cigarette filter consisting of the following phases:

(a) cold mixing polypropylene with a blowing agent and a porogenous agent:
(b) melting and spinning the mixture formed in step (a);
(c) drawing of a tow of polypropylene as obtained in phase (b):
(d) impregnating of the tow in an aqueous solution of stiffening substances containing, if necessary, a suspended porogenous agent;
(e) crimping the tow;
(f) fixing the tow by heating it in a furnace;
(g) treating the stabilization tow with a plasticier; and
(h) making up the tow into cylindrical shapes for cigarette filters.

The new type of porous fibers according to the invention have a special ramified structure due to the presence of a porous central core and a large number of short lateral porous filaments, shorter than the core but integral with it, distributed uniformly along its entire length.

This special fiber structure is achieved by means of the procedure which is one of the subjects of the invention.

Thanks to the inclusion in the fiber-forming polymer, of the inflating or blowing agent and the subsequent heating during the phase of melting the mixture for the spinning of the fiber, the inflating agent first forms gaseous compounds trapped in the fiber in the form of micro-bubbles which, following further expansion due to the heating, "explode" and cause the fiber to fringe, at least on the surface, with the consequent formation of the previously described porous ramified structure. The subsequent phase of drawing the fiber completes the "fringing" effect of any remaining micro-bubbles giving rise to the finished ramified structure of the fiber in question which is then fixed by means of heat treatment, as happens with traditional fibers.

It has been discovered that the best results are achieved by preparing the fibers of the invention from polypropylene or from copolymers of propylene with ethylene in various proportions, such as, for example, the commercially available copolymers which contain up to 50% of ethylene in the copolymer.

Thanks to the intrinsic properties of these polymers and in particular to their visco-elastic properties and their consequent high resistance to elongation and high tensile strength, the process of "fringing" and ramification does not lead to the breaking of the central core of the fiber which in practice acts as the carrying frame for the structure obtained.

The fibers according to the invention are therefore more voluminous than traditional fibers and also (bulky) than mechanically carded fibers, for example, with the result that it is possible to achieve the same degree of porosity by using a smaller quantity of polymer to produce the fiber (for example, a quantity at least 10% smaller by weight) or to obtain a considerably greater amount of porous fiber with an equal amount of polymer.

In the spinning process required to obtain the fiber as per the invention, a large number of fibers is obviously obtained, as with all spinning processes.

Thanks to the special nature of the process which includes the blowing agent in the fiber forming polymer, and as a result of the fringing effect of the blowing agent, the ramified structure of each fiber will interpenetrate that of the adjacent fibers, so that rovings are obtained which are directly suitable for many kinds of application involving the use of porous fibers.

The blowing agent to be used according to the invention may be one of a series of compounds acting chiefly as expanding agents, in particular, azobicarbonamide, 4-4-hydroxybis((benzenesulphonyl)hydrazide, ammonium carbonates and bicarbonates and/or alkaline metals.

Particular preference is given to azobicarbonamide since it gives rise to extended ramification of the fiber.

The process of the invention is preferably performed by mixing the polymer and the blowing agent in a weight ratio of 0.05 to 1.0%. The spinning through melting is preferably performed by using special "X" or "Y" profile dies at a temperature which varies according to the specific polymer in question, but which for polypropylene and its copolymers is generally from 260° to 310° C.

The drawing of the fibers thus obtained is generally carried out with a drawing ratio from 1:2 to 1:3, while fixing is performed in the traditional way (for example in a furnace at a temperature of approximately 105°–130° C.).

The fibers or tow obtained by means of the procedure as per the invention can be used in all applications that until now have required the use of porous fibrous masses, in particulr filters, padding, etc.

In this type of application of fibrous mass can be combined with additives, adjuvants, auxiliaries, etc., selected according to the specific use required. Thus, one particular application of the fibers that are the subject of the invention is, for example, that of the preparation of filters for cigarettes, as is described in more detail in the paragraphs below.

As mentioned previously, the procedure for the preparation of such a filter implies the addition during the mixing phase (a) of a porogenous agent as well as the inflating agent.

The porogenous agent, as per the invention, can be mixed with the polymer, for example to the polypropylene before spinning, or it can be applied to the fiber at a subsequent phase, after spinning.

Porogenous substances that are especially suited for the invention are: calcium carbonate, talc and amorphous silica.

The particle size of the amorphous silica is preferably less than 1 micron.

One of the porogenous agents that is particularly active in holdng back the harmful substances contained in cigarette smoke is calcium carbonate. After the spinning phase, the porogenous agent is distributed statistically on the threads of both the core and the lateral filaments.

This makes each thread highly absorbent and at the same time extremely rigid.

Moreover, the filaments tend to join together, by means of the lateral threads, thus giving rise to a tow of polypropylene which acts as a support, inasmuch as it has a large number of interstices inside it, for the other absorbent and sizing substances used in the impregnation phase during the "foulard" bath.

The mixtures used during the finishing phase contain porogenous substances, such as, for example, $CaCo_3$ prepared in particular with anti-static and lubricating substances, such as stearic acid, bathed in an antistatic lubricating substance, such as polyethyleneglycol, and with the addition of absorbent sizing substances such as starch.

These mixtures enable the product to undergo crimping to increase the voluminosity of the polypropylene tow, without problems of processability. Moreover, during the filter making phase the $CaCo_3$ does not become powdery, thanks to the stearic acid coating the individual particles.

Another advantage is that as well as bonding the filaments together these substances also absorb the products contained in the tobacco smoke and the product thus obtained effectively condenses the distillates of the smoke so that they can be cooled as a result of the large number of interstices that exist between the various threads that make up the filter itself. The polypropylene tow is then inserted into a filter-making machine which advantageously has the rollers in a closed position at 1–1.8 ate; in addition, polyvinyl pyrrolidone is used as a plasticizer during the filter-making phase in order to achieve greater cohesion.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
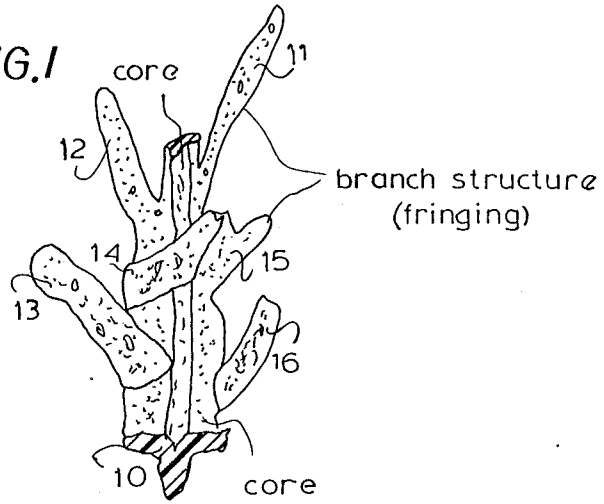
FIG. 1 is an elevational view, partly in section, through a portion of a filament in accordance with the invention.

In FIG. 1 of the drawing, I have shown a filament spun as a Y-shaped structure 10 which has been subjected to fringing so as to form threads 11, 12, 13, 14, 15 and 16 which branch from the core and have lengths less than the lengths of the core. The threads or fringes are formed by the explosion of the gaseous compounds trapped in the form of the micro-bubbles in the filament as it emerges from the melt spinning stage. The fringes 11–16 can be seen to be porous as is the core 10 itself. A X-section filament can also be spun as described previously.

Figure 2:
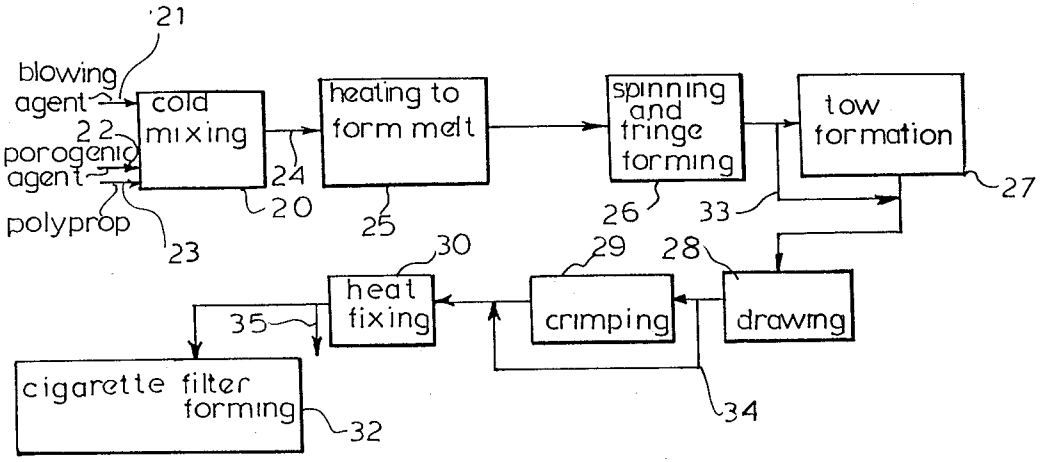
FIG. 2 is a block diagram of the method.

In FIG. 2, I have represented diagrammatically the method of process of the invention.

The blowing agent introduced at 21, the porogenic agent introduced at 22 and the polypropylene introduced at 23 are cold-mixed in the initial stage 20 and the composition 24 is then heated in stage 25 to form a melt which is subjected at 26 to spinning through X-shaped or Y-shaped orifices to effect filament formation and the formation of the threads or fringes on the filaments.

The filaments are then gathered at 27 into a tow and the tow is subjected to drawing at 28. The drawn tow may be crimped at stage 29 and the crimped drawn tow can be subjected to heat fixing by passing it through an oven represented at 30 at a temperature of 105° to 130° C. at a speed of 2 to 5 meters per minute. The heat fixed tow can be form at 32 into cigarette filters.

It is possible to subject the spun fibers to drawing without tow formation as represented by arrow 33 and then to subject the drawn fibers to heat fixing as represented by arrow 34, thereby yielding a product at 35 which is useful for other applications than the formation of cigarette filters.

Figure 3:
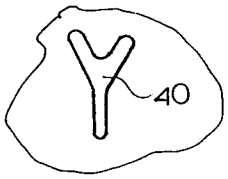
FIGS. 3 and 4 are elevational views of the spinning orifices in two embodiments of the invention.
Figure 4:
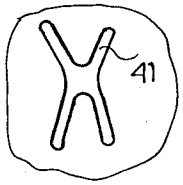

In FIG. 3 I have shown an orifice 40 of Y configuration while in FIG. 4 the orifice 41 has an X configuration for spinning the filament.

The procedure for the manufacture of the cigarette filter, which is the subject of the invention, consists of the following phases.

Cold mixing of the various components in the form of flakes and highly stereospecific base polypropylene with MI=12 in a slow mixer at a temperature of approximately 20° C. for a period of about 30 g/min. Then spinning by melting is performed at a temperature of between 260° C. and 310° C. with the use of the previously described "Y" or "X" section dies in order to create the lateral threads on the individual filaments which are charged with porogenous agents such as, for example, calcium carbonate.

After spinning the filaments are treated with antistatic substances and then bathed in water to eliminate as much of the anti-static substances as possible in order to create a product that is non-toxic.

After the water bath, the polypropylene tow is passed over the first roller (a slow roller) at a temperature of 60° C.–80° C. and is then drawn in a steam furnace at 120° C. with a drawing ratio of between 1:2 and 1:3, before being fed onto a second roller (a fast roller) at a temperature of approximately 120° C.

After the tow has passed over the fast roller at a temperature of 120° C., it is subjected to a "foulard" bath in an aqueous solution of lubricants, for example polyethyleneglycol, which also consists of porogenous inorganic charges, $CaCo_3$ prepared with lubricating, anti-static stearic acid, and sizing substances such as starch; the concentrations of the abovementioned substances varies according to the charge required to obtain filters of the compactness desired.

The subsequent phases of the procedure consist chiefly of phases of the mechanical type, such as for example the wringing of the tow and the crimping of the same to increase its voluminosity, forming on it about 5–8 waves cm.

Finally the tow is stabilized (annealed) in a furnace at a temperature of 105°–130° C. at a speed of approximately 2–5 mts. a minute, followed by packing with presses and the unwinding of the polypropylene tow in order to be fed into an opener on the filter making machine which will have rollers closed at a pressure of 1 to 1.8 ate; cellulose paper is also used for the making of the filters.

As an example, we give below an example of the manufacture of a filter:

(1) Mixing for 15 minutes in a Battaggion type slow mixer at 30 rpm at a temperature of 20° C. of the following components:

(1a) 97.8% of polypropylene, fiber type, highly stereospecific, melt index=12, containing:

0.2% of calcium stearate (anti-acid)

0.15% of heat stabilizer (anti-oxidant)

(1b) 2% of white flake containing:

1% of $TiO_2$ 0.5% of $CaCo_3$ 0.5% of low density polyethylene, MI=20

(1c) 0.2 azobicarbonamide flake, containing:

0.08% of azobicarbonamide 0.12% of low density polyethylene MI=20

(2) Melting and spinning of the tow under the following conditions:

(2a) Use of a temperature profile of:

260° C. in the feed zone

290° C. in the body of the extruder

300° C. in the filter zone

290° C. in the die zone (2b) Use of a filter before the die composed of three 10,000 mesh/sq.cm. mesh filters:

(2c) Use of "Y" section dies

Tow on output from die with 20.4 denier per hole.

(3) Treatment with an anti-static product (4) Hot drawing in steam at 120° C. with a temperature of 80° C. before the furnace and a roller temperature after the furnace of 120° C. Drawing ratio 1:3. The characteristics of the tow thus obtained are as follows:

count of each filament: 6.8 denier total count: 35,360 denier (5) "Foulard" bath treatment of tow in an aqueous solution containing:

(5a) Starch solution in water with traces of diluted acetic acid to assist hydrolysis into:

maltose $C_{12}H_{22}O_{11}$ and

Dextrin (C6H1005) n=50–60.

(5b) 50% solution of polyethyleneglycol (steeping) and 50% $CaCo_3$ with stearic acid on the outside of each particle (this is necessary for lubrication purposes during the subsequent crimping phase and to avoid the powdering of the $CaCo_3$ when the tow is put into tubes of cellulose paper to make the filter).

(5c) Solution for 'foulard' bath after mixing the two solutions, the solution for the 'foulard' bath must contain, in total:

8.3% starch 8.3% $CaCo_3$

25% polyethyleneglycol, n=600

58.4% water (6) Wringing (7) Crimping to create 8 waves/cm. of undulation on the filaments.

(8) Passage through furnace at 105°–110° C. to stabilize the tow at a furnace belt speed of 3 mts/min.

(9) Packing of the tow in order to avoid folds and/or twists.

(10) The total count of the tow, with the addition of starch and CaCO3, becomes: 43,600 denier. The table below gives comparative data between the analysis of a filter as per the invention as prepared in the way described above and a traditional cellulose acetate filter.

FUNCTIONAL ANALYSIS OF A P.P. FILTER AS COMPARED WITH A CELLULOSE ACETATE FILTER

| | P.P. FILTER | CELL. AC. FILT. |
|---|---|---|
| Length of cigarette (mm) | 84 | 84 |
| Weight of cigarette - filter (gr) | 1080 | 1080 |
| Weight of tobacco cylinder (gr) | 0.925 | 0.9235 |
| P inhalation of cig. (mm/water) | 100–110 | 100–110 |
| Relative humidity of environment of smoke test (%) | 12.46 | 13.16 |
| P inhalation only of 20 mm. filter (mm/water) | 41 | 49 |
| no. of inhalations by smoke machine needed to finish cigarette (no. of inhalations) | 13.7 | 13.5 |
| Residue of filter and cigarette after smoke test (mm) | 28 | 28 |
| Condensate + Humidity + Nicotine (mg/cigarette) | 38.27 | 34.77 |
| Humidity held in filter (mg/cig.) | 4.37 | 4.26 |
| Nicotine held in filter (mg/cig.) | 1.39 | 1.26 |
| Tar held in filter (mg/cig.) | 32.5 | 29.25 |
| Weight of one filter (mg) | 177.5 | 156.5 |
| Total denier count (den.) | 43.620 | 36,000 |

In practice it was shown how the cigarette filter and the procedure for producing it are particularly advantageous with regard to the reduction of the a-mount of tar contained in the tobacco smoke and to the high condensation of the distillates of the smoke to enable cooling in the large number of interstices between the various filaments that make up the thread itself.

As the invention has been conceived it can be modified in many ways and still remain within the sphere of the concept of the invention; moreover, all the details can be replaced by technically equivalent elements. In practice any materials can be used and any dimensions adopted according to the requirements of the state of the art.

I claim:

1. Tow of synthetic fibres characterized in that it comprises each of said fibres formed by a porous central core and a plurality of porous lateral filaments attached with said core and shorter than it, said lateral filaments being distributed along the whole length of said fibre to form a ramified structure, the ramified structure of each fibre in terpenetrates the ramified structure of the surrounding fibres so as to form a porous fibrous mass of increased voluminosity.

2. Tow according to claim 1 wherein said fibres consist of a polymer chosen from either polypropylene or copolymers of propylene-ethylene.

3. Tow of synthetic fibre characterized in that is comprises a plurality of fibres according to claim 1 wherein the ramified structure of each fibre interpenetrates with the ramified structure of the surrounding fibres so as to form a porous fibrous mass of increased voluminosity.

4. A process for making a high-bulk fiber, comprising the steps of:

(a) cold mixing a fiber-forming synthetic polymer with a blowing agent to form a spinnable filament-producing mixture;

(b) heating said mixture to form a melt and melt-spinning said mixture through X-section or Y-section orifices to produce fibers therefrom and generate by a swelling and fringing action of heat and said blowing agent the formation of ramified structure consisting essentially of a porous central core and porous lateral filaments branching from said core and shorter than said core, said lateral filaments being distributed over substantially the entire length of each spun fiber;

(c) drawing the spun fibers of said ramified structure of step (b); and (d) fixing the drawn spun fibers of step (c).

5. The process defined in claim 4 wherein said fiber-forming synthetic polymer is selected from the group which consists of polypropylene and copolymers of propylene and ethylene, said blowing agent being selected from the group which consists of azobicarbonamide, 4-4-hydoxybis(benzenesulphonyl) hydrazide, ammonium carbonates and bicarbonates and alkaline metals.

6. The process defined in claim 5 wherein said fiber-forming polymer is polypropylene and said blowing agent is azobicarbonamide.

7. The process defined in claim 5 wherein the weight ratio between said fiber-forming synthetic polymer and said blowing agent is 0.05 to 1%.

8. The process defined in claim 7 wherein the melt-spinning in step (b) is carried out at a temperature of 260° to 310° C., the drawing in step (c) is carried out with a drawing ratio of 1:2 to 1:3 and the fixing in step (d) is carried out by heating the drawn spun fibers in a furnace at a temperature of 105° to 130°.

9. A process for making a cigarette filter, comprising the steps of:

(a) cold mixing a fiber-forming synthetic polypropylene polymer with a blowing agent and a porogenous agent to form a spinnable filament-producing mixture;

(b) heating said mixture to form a melt and melt-spinning said mixture through X-section or Y-section orifices to produce fibers therefrom and generate by a swelling and fringing action of heat and said blowing agent the formation of ramified structure consisting essentially of a porous central core and porous lateral filaments branching from said core and shorter than said core, said lateral filaments being distributed over substantially the entire length of each spun fiber;

(c) drawing the spun fibers of said ramified structure of step (b);

(d) forming a tow of the drawn spun fibers of step (c);

(e) crimping the tow of step (d);

(f) fixing the crimped tow by heating the tow at a temperature of 105° to 130° C. in a furnace at a speed of 2 to 5 meters per minute to form a fiber mass; and (g) forming said fiber mass into cylindrical cgarette filters.

10. The process defined in claim 9 wherein said porogenous agent is selected from the group which consists of calcium carbonate, talc and amorphous silica with a particle size of less than 1 micron.

11. The process defined in claim 10 wherein the porogenous agent is calcium carbonate.

12. The process defined in claim 10 wherein said blowing agent is selected from the group which consists of azobicarbonamide, 4-4-hydoxybis(benzenesulphonyl)hydrazide, ammonium carbonates and bicarbonates and alkaline metals.

13. The process defined in claim 10 wherein said tow is impregnated in an aqueous solution containing at least one substance selected from the group which consists of starch, acetic acid, calcium carbonate and polyethylene glycol prior to crimping.

14. The process defined in claim 13 wherein said substances is starch together with acetic acid.

15. The process defined in claim 13 wherein said substance is polyethylene glycol.

16. The process defined in claim 15 wherein said solution includes particles of calcium carbonate.

17. Synthetic fiber characterized in that it comprises a porous central core and a large number of porous lateral filaments integral with said core and shorter than it, said lateral filaments being distributed along the whole length of said fiber to form an increased volume ramified fiber structure as made by the process of claim 4.

18. Tow of synthetic fibers as made by the process of claim 4 characterized in that it comprises each of said fibres formed by a porous central core and a plurality of porous lateral filaments attached with said core and shorter than it, said lateral filaments being distributed along the whole length of said fiber to form a ramified structure, the ramified structure of each fiber interpenetrates the ramified structure of the surrounding fibers so as to form a porous fibrous made of increased voluminosity.

19. Cigarette filter characterized in that it comprises a tow of fibers of porous polypropylene made by the process of claim 4; each of said polypropylene fibers consist of a large number of porous lateral filaments integral with the core so as to form a ramified structure; the ramified structure of each fiber interpenetrates the ramified structure of the surrounding structures so as to form a filter that is rigid and which possesses high absorbent capacity.

20. Cigarette filter according to claim 19 wherein said tow is impregnated with particles of calcium carbonate.

21. Cigarette filter according to claim 20 wherein said particles of calcium carbonate are treated with stearic acid.

22. Cigarette filter according to claim 19 characterized in that said tow is impregnated with polyethyleneglycol.

23. Filter according to claim 19 characterized in that said tow is impregnated with starch.

24. Filter according to claim 19 characterized in that said tow has a total count of from 30,000 to 55,00 deniers and is formed by fibres which each have a count of from 3 to 8.5 deniers.

* * * * *